United States Patent [19]

Toth

[11] 4,243,696

[45] Jan. 6, 1981

[54] METHOD OF MAKING A PARTICLE-CONTAINING PLASTIC COATING

[75] Inventor: William L. Toth, Trumbull, Conn.

[73] Assignee: W. S. Rockwell Company, Fairfield, Conn.

[21] Appl. No.: 5,379

[22] Filed: Jan. 22, 1979

Related U.S. Application Data

[63] Continuation of Ser. No. 788,264, Apr. 18, 1977, abandoned.

[51] Int. Cl.[3] ..... B05D 5/02; B05D 1/28; B05D 1/30; B05D 3/02

[52] U.S. Cl. ..... 427/27; 118/308; 118/320; 427/180; 427/195; 427/201; 427/204; 427/428; 428/407

[58] Field of Search ..... 428/407; 404/19, 20, 404/21; 427/180, 195, 201, 204, 21, 27, 428; 118/368, 320

[56] References Cited

U.S. PATENT DOCUMENTS

| | | | |
|---|---|---|---|
| 2,748,019 | 5/1956 | Schramm | 427/201 X |
| 2,789,926 | 4/1957 | Finholt et al. | 427/195 |
| 2,793,136 | 5/1957 | Root | 427/180 |
| 2,972,551 | 2/1961 | Fringhian | 427/196 |
| 2,987,102 | 6/1961 | Heinrichs | 427/201 X |
| 3,078,510 | 2/1963 | Rowe | 427/196 |
| 3,081,698 | 3/1963 | Childress et al. | 427/21 |
| 3,097,080 | 7/1963 | Weir | 427/201 |
| 3,140,195 | 7/1964 | Nagel | 427/185 X |
| 3,161,114 | 12/1964 | Wittenwyler | 427/195 |
| 3,308,725 | 3/1967 | Nagin et al. | 94/4 |
| 3,385,722 | 5/1968 | Weaver et al. | 427/201 X |
| 3,523,031 | 8/1970 | Walters | 427/201 X |
| 3,930,070 | 12/1975 | Cronenberger et al. | 427/185 |
| 3,948,294 | 4/1976 | Magarian et al. | 427/204 |
| 3,953,623 | 4/1976 | Das | 427/195 X |
| 3,989,859 | 11/1976 | Koerper | 427/47 X |
| 4,011,354 | 3/1977 | Drostholm et al. | 427/201 X |
| 4,040,993 | 8/1977 | Elbling et al. | 427/27 |
| 4,107,356 | 8/1978 | Ukihashi et al. | 427/195 |

FOREIGN PATENT DOCUMENTS

| | | |
|---|---|---|
| 251229 | 1/1961 | Australia . |
| 991770 | 5/1965 | United Kingdom . |

*Primary Examiner*—Shrive P. Beck

*Attorney, Agent, or Firm*—Parmelee, Johnson, Bollinger & Bramblett

[57] ABSTRACT

A method and apparatus for making particle-containing plastic coatings on articles comprises cascading onto prepared surfaces of the articles a mixture of powdered resin and particulate material and adhering and curing the mixture onto the prepared surfaces by heating.

12 Claims, 6 Drawing Figures

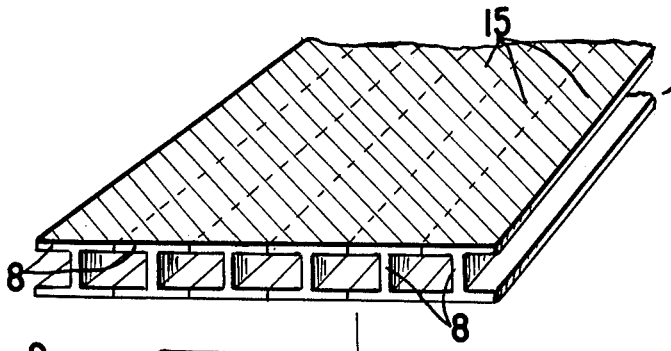
FIG. 1A
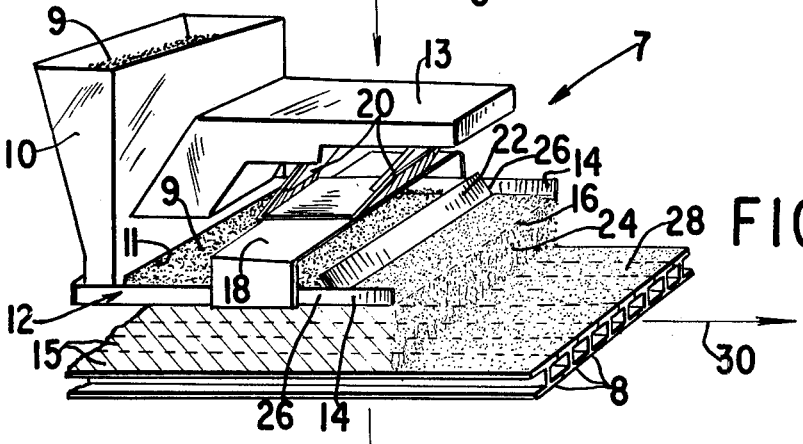
FIG. 1B
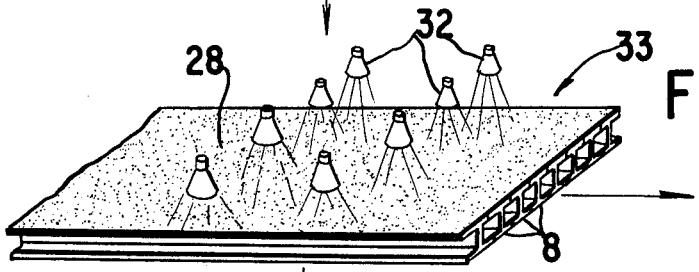
FIG. 1C
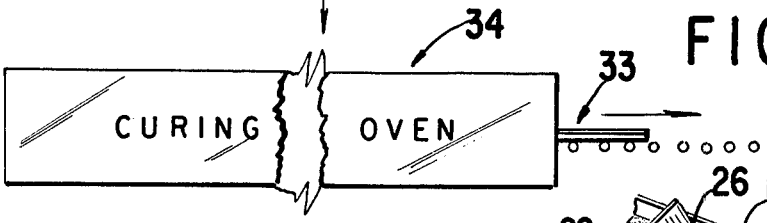
FIG. 1D
FIG. 2
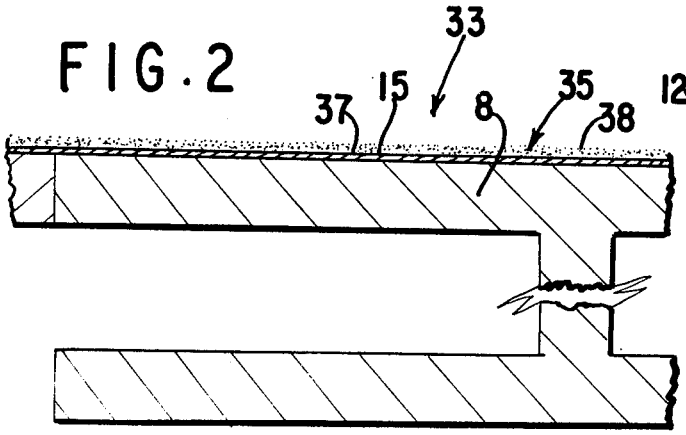
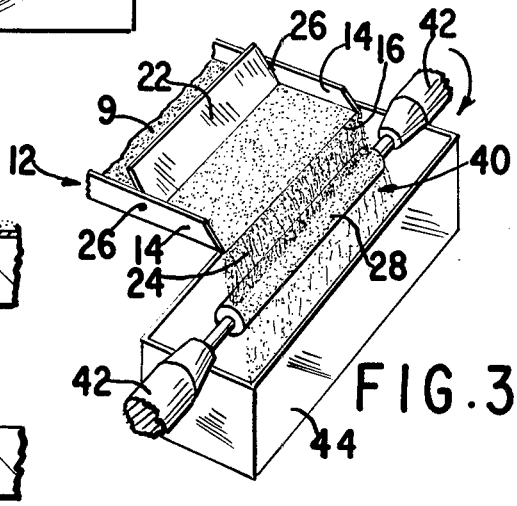
FIG. 3

METHOD OF MAKING A PARTICLE-CONTAINING PLASTIC COATING

This is a continuation of application Ser. No. 788,264 filed Apr. 18, 1977, now abandoned.

DESCRIPTION

This invention relates to particle-containing plastic coatings on articles and method and apparatus for making such coatings for producing non-slip, reflective and electrical insulating coatings for various articles. Examples of the non-slip coating applications are constructional elements for platform tennis courts, stair treads, swimming pool decking, corridor floor panels, walkway panels, ladder treads and steps where durability and toughness are desired. Examples of the reflective coating applications of various colors are signs, reflective highway dividers, barriers, fencing and warning reflectors. Examples of electrical insulating coating applications are armature shafts and components, electrical bus bars and electric motor elements where high electrical insulating qualities are required.

Non-slip, reflective, or insulating plastic coatings containing particulate matter for such types of applications have generally been applied by complex processes, but the products obtained frequently lacked durability or good bonding characteristics. Low durability and/or poor bonding is a particularly serious problem in the art when high loadings of filler imparting non-slip, reflective, or reinforcing properties are used in a resin coating medium.

McGroarty, U.S. Pat. No. 3,676,198 teaches application of granular bentonite material to a substrate by mixing it with an adhesive substance. Although a high loading of bentonite to adhesive (about 5:1) is achieved, the surface so coated is relatively impermanent, owing to gradual deterioration of the carbohydrate-based adhesive selected.

Trieschmann et al., U.S. Pat. No. 3,575,780, shows the use of ground rubber or cork, bonded by polyvinyl chloride (PVC), acrylic resins or polyisobutylene for coating the surface of a playing field. However, unless special thermoplastic molded materials, i.e., a combination of bitumen with an ethylene-butyl acrylate copolymer, are used and a particular structure is employed, the surface gain resiliency at the expense of a decrease in hardness and durability.

Sallie, U.S. Pat. No. 3,014,812, teaches that particular matter can be distributed across the width of a travelling substrate by rotating an impeller about an axis to give centrifugal acceleration to the particulate matter and achieve a uniform coating.

Draper, et al., U.S. Pat. No. 3,547,674, show the use of crumb rubber, which is compacted and oriented during preparation of a surface, as a top layer of a construction for a prepared surface, such as a playing field.

Smith, et al., U.S. Pat. No. 3,745,034, teach the deposition of a metallic powder on a metal strip by an electrostatic technique using a gaseous aerosol, which itself is undesirable. It is apparent that this complex technique requires electrodes, high voltages, and aerosol supply and complicated ancillary structures.

Raichle, et al., U.S. Pat. No. 3,446,122, employ a water-permeable flexible top-covering layer for surfaces to be used for recreational activities. The covering layer is supported on an elastic layer supported over a filter layer, such as gravel or sand. In a preferred embodiment, grass, which must be mowed, fertilized and cared for, is used as the top layer to provide a structure which has the required elasticity for a surface for sportsgrounds, playgrounds, or footpaths.

Among the many advantages of using the method and apparatus of the present invention for making particle-containing plastic coatings on various articles are those resulting from the fact that there is significant convenience and flexibility in carrying out the method and in using the apparatus to produce coatings in a wide variety of colors and with different sizes, types, and amounts of particles therein to achieve various surface effects and characteristics for different applications and to obtain a strong bonding medium with a long wear life.

Among the objects of the invention is to provide resilient, simple constructed, relatively permanent, easily maintained, anti-slip surfaces for sportsgrounds, platform tennis courts, stair treads, swimming pool decks, corridor floor panels, walkways, ladder treads, and the like.

Among the further objects of the invention is to provide method and apparatus for conveniently and efficiently applying reflective and reinforced electrical insulating coatings to a wide variety of manufactured articles.

These and other objects, features and advantages of the present invention will become apparent from a consideration of the following detailed description in connection with the accompanying drawings, which are exemplary of the presently preferred embodiments of the invention.

BRIEF DESCRIPTION OF THE DRAWINGS

In the drawings:

FIG. 1A is a perspective view of a portion of a substrate, such as a platform tennis or paddle tennis court, which can be coated according to the invention;

FIG. 1B is a perspective view showing the apparatus used in accordance with the invention for producing an anti-slip particle-containing coating on such a substrate structure;

FIG. 1C and FIG. 1D show two different types of heating apparatus in which the heat curing of the particle-containing plastic coating on a structure can be carried out;

FIG. 2 shows an individual structure element of the platform or deck of FIG. 1, which has been coated in accordance with the present invention; and FIG. 3 is a partial perspective view illustrating a cylindrical body being coated in accordance with the method and apparatus of the invention.

DETAILED DESCRIPTION

Where appropriate, the same parts in the various Figures are given the same reference numerals.

A typical level surface where anti-slip qualities are very desirable is a substrate such as a paddle tennis court assembly 6 as seen in FIG. 1A. The upper surfaces of the structural elements 8 of this platform assembly 6 can be coated to advantage by employing the present invention. These elements 8 are in the form of web-type structural members, which preferably are individually coated and then assembled. However, if desired, depending upon their size, they can be coated in an assembled form or as portions of a sub-assembly.

In accordance with the practice of this invention, the upper walking surface 15 of each structural web member 8 is suitably prepared, including the steps of being cleansed thoroughly to remove any dirt or traces of grease or oil and being mechanically or chemically etched. As shown in FIG. 1B by the arrow 30, one or more suitably prepared structural elements 8 of the substrate 15 are passed beneath particle-containing coating application apparatus, generally indicated at 7. A mixture 9 of dry powdered form resin and a particulate abrasive or non-slip material is placed in the hopper 10 and issues through a bottom outlet 11 into a trough 12 which has feeder fluidizing means 13 associated therewith. This trough has a pair of parallel side walls 14 with a downwardly inclined wide flat bottom extending between the side walls. The trough 12 is adjustable in slope and inclines downwardly slightly toward a cascade-creating lip 16 defined by the straight terminal edge of the bottom of the trough.

In this application apparatus 7, the fluidizing feeder means 13 is a vibratory feeder mounted on a bridge 18 which spans in elevated relationship between the side walls 14 of the trough. A pair of inclined leaf springs 20 serve to secure the vibtatory feeder 13 to the bridge 18. These springs 20 incline upwardly and forwardly toward the lip 16, so that the mixture 9 of dry resin powder and non-slip particulate matter is fed by the feeder 13 along the trough 12 toward its lip 16. The advancing mixture 9 is leveled to a constant thickness by control gate means 22 to form a uniform cascade or waterfall 24 of this mixture which uniformly falls on the substrate 15 being coated.

The control gate 22 includes a straight barrier which is mounted by pivots 26 to the opposite side walls 14. Thus, the spacing between the lower edge of the control gate barrier 22 and the bottom of the trough 12 can readily be adjusted by turning the gate about its pivots for controlling the amount per unit time of the cascading flow 24 for controlling the thickness of the uncured particle-containing coating 28 being applied. Clamping means, for example, such as a split collar surrounding each pivot shaft 26, may be used to secure the adjusted gate position. Other ways to control the thickness of the coating 28 are to change the vibratory feed rate of the vibrator and to change the downward inclination of the tray 12 and to change the rate of travel 30 of the prepared substrate 15 being coated, and combinations of these changes may be used for convenient control of coating thickness. However, in most instances, the most convenient method of changing the coating thickness is to adjust the control gate 22 and then clamp it in position. Although a group of the members 8 are shown in FIG. 1B passing simultaneously under the cascading mixture 24, in most cases, the members 8 may be individually coated as discussed above.

Alternatively, the fluidizer feeder means 13 may comprise an aerated fluidizing tray (not shown) associated with the trough 12 for causing the mixture 9 to flow freely along the downwardly inclined trough past the control gate 22 and over the waterfall lip 16.

The uncured mixture coating 28, which is thus spread on the prepared substrate in a uniform layer, is then heated, for example, by infrared heating lamps shown in FIG. 1C as 32 to make the finished article 33. Optionally, curing of the resin-particulate matter mixture can be completed by passing through a curing oven 34 (FIG. 1D) to make the finished article 33. It will be understood that a powdered priming layer of resin, if present, as discussed below, and the particle-containing coating layer can both be cured together simultaneously to form the cured and bonded anti-slip coating 35 (FIG. 2).

In the embodiment of the invention, as described, the prepared substrate 15 is caused to move past the applicator apparatus 7, seen in FIG. 1B, for applying the mixture 9 uniformly onto the prepared substrate surface. It will be understood by those skilled in the art that the substrate 15 can be held stationary, and the applicator apparatus 7 can be moved relative thereto.

The control gate 22 is shown at an advantageous location which is in the range from approximately 2 to 3 inches from the lip 16. This lip 16 from which the cascade 24 falls is preferably positioned relatively close to the prepared substrate surface 15. For example, this vertical spacing is in the range from approximately $\frac{1}{8}$th of an inch up to $\frac{1}{2}$ of an inch. This relatively close spacing provides a greater degree of uniformity in the applied coating layer 28 than would be achieved by permitting a larger vertical height of the cascading fall 24.

It will be appreciated that the thickness of the coating applied to the substrate can be controlled and adjusted as described above. In order to provide a tough, durable, and very effective anti-slip coating for a wide range of walking surfaces such as discussed in the introduction, the coating 35 (FIG. 2) after curing on the finished article 33 has a thickness of from approximately 30 mils to approximately 50 mils. It is to be noted, however, that the method and apparatus as described are capable of making particle-containing plastic coatings up to a thickness of at least 80 mils, on a prepared substrate, if desired, for specialized applications.

The prepared substrate 15 to which the coating mixture is applied must at the least be thoroughly cleaned and mechanically or chemically etched, as discussed earlier above. However, better adhesion of the resin-particulate matter 9 is obtained if the substrate 15 is primed with a base coating of the same resin component as in the mixture. For priming the substrate with the resin, finely divided powder, of the order of 30 to 50 microns in size is used. It is preferable to apply the dry primer powder resin electrostatically, or by a paint type roller having nap which acts as powder distributing means for spreading the resin evenly over the surface. This primer layer acts to cover the surface for preventing minute blank spaces or voids underneath the grit particles.

This base coating may be in the range from approximately one to three mils thick, and its purpose is to act as a primer to provide a stronger bond between the substrate 15 and the particle-containing coating mixture 9. This base coating, as mentioned, also provides the possibility that grit particles in the subsequently applied coating might "shadow" very small regions of the substrate 15, so as to cause minute voids where the resin is absent adjacent to the substrate. In most instances, the preferred procedure is to include the base coating step for achieving a tough, durable bond to the substrate. When a thermoplastic resin powder is used in the mixture 9, the priming step is always carried out. The primed surface 15 is coated as described above, and cured after the resin particulate matter mixture has been applied on top of the primer layer.

The dry powdered resin used in the mixture 9 may be any commercially available one-part free-flowing fluidizable bed grade or electrostatic powder spraying grade resin powder of the kinds described bbelow. Generally, the electrostatic grade powder is somewhat finer than the fluidizable bed grade, but either grade may be used.

The various kinds of these grades of resin powders which may be used to advantage include the following thermosetting resin materials; epoxy and polyester, and also include the following thermoplastic resin materials: polyamide ("Nylon"), polyester, polyethylene, polypropylene, polyvinylchloride and polyurethane.

The powdered resin materials which may be used generally have a specific gravity in the range from approximately 1.2 to 2.3; however, in the majority of applications the specific gravity range of approximately 1.2 to approximately 1.8 is preferred.

Alumina, silicon carbide, silica sand, glass, quartz, and fiber glass, or mixtures thereof, are appropriate particulate fillers for the mixtures to use in the method and apparatus of this invention. The fillers have a particle size of No. 50 to No. 100 grit size (mesh size) and preferably No. 60 to No. 80 grit size for coatings on walking and running surfaces, as explained below.

Of the particulate fillers, alumina is preferred for anti-slip coatings on walking or running surfaces. "Alumina", as used in the specification and claims, includes $Al_2O_3$ and its various hydrates.

The coated substrates made in accordance with this invention are characterized by a relatively high loading or particulate matter to resin. The loading of particulate matter can be from 5 to 14 parts by weight of particulate matter per part of dry powder resin, depending upon the intended end use, whether an anti-slip, reflective or electrically insulative usage.

When fiber glass is used as a reinforcement in combination with one of the grit particulate fillers, the weight of fiber glass is about 2–10% of the dry powdered resin. If fiber glass is used as a filler for strengthening the coatings, an average length of less than one-eighth of an inch is preferred.

Surprisingly, the highly loaded cured solid resins used in the method of this invention adhere to the substrates being coated considerably more tenaciously than the liquid used heretofore and generally last twice as long as those made using liquid resin application methods.

For producing an anti-slip coating for withstanding walking or running, the particles of the particulate abrasive or non-slip matter should have a size in the preferred range from No. 60 grit to No. 80 grit. If the non-slip particles are too small, the non-skid character of the surface is lessened. On the other hand, if these particles are too large, then their over-turning moment becomes unduly increased. The result is that powerful lateral skidding thrusts of shoe soles along the surface tend to overturn or roll the large particles causing them to become loosened from the plastic medium in which they were bonded. For example, for a paddle tennis floor surface, a No. 60 to No. 80 grit size works to advantage in providing strong anti-slip qualities while resisting loosening of the grit particles.

For making an anti-slip surface on which people may often sit, the size of the grit in the seating area may be reduced to No. 100 grit size.

The weight ratio of the grit particles to the powdered resin for a tough, durable anti-slip coating is in the range from approximately 5 to 10 parts by weight of grit to each part of the resin powder. A mixture which is much richer in resin than approximately 5 pounds of grit to 1 pound of resin although having excellent bonding strength tends to be too shiny or slick. Conversely, a mixture which is much leaner in resin than approximately 10 pounds of grit to 1 pound of resin tends to be lower in bonding strength for the grit particles than as provided in the preferred weight ratio range for a walking or running surface as set forth above. The preferred range is 8 to 10 parts by weight of grit to one part by weight of epoxy resin powder for the toughtest types of usage, for example, such as on a sports platform assembly as shown in FIG. 1A.

Planar substrates which are advantageously coated by the method of this invention include platform tennis courts, stair treads, swimming pool decking and walkways. The substrate depicted in FIG. 1A is typical of that used for platform tennis constructions.

The method of this invention can be used for applying electrical insulative coatings to cylinders, rods or shafts by turning the cylinder, rod or shaft while the resin or mixture is cascaded over the substrate as shown in FIG. 3. The substrate is heated and cured in the same fashion as a planar substrate. Typical of the product obtained in this way is that shown in FIG. 3, wherein 40 represents the cylindrical, rod-like or shaft-like substrate held in rotating fixture means 42. For this rotating application embodiment of the invention when using thermoplastic resin material, the substrate 40 is preferably first heated and coated with a primer, that is, with the dry powdered resin, and then with more of the resin powder in the cascade 24 (FIG. 3). A bin 44 serves to catch any of the mixture which may fall below the prepared substrate 40.

The coated substrate 40 is then cured by heat as described above. Cylinders, rods or shafts coated in this way are used for example for wear and corrosion resistance as feed rolls in paper handling machinery and for example for anti-corrosion and wear-resistance as textile handling components. Also, cylinders, rods and shafts may be coated in this way to provide an electrical insulation coating of high dielectric strength for use as armature shafts, motor components, etc.

The method of this invention is also used with irregularly shaped substrates, preferably by heating the substrate prior to application of the primer and continuing as above.

In the heat curing step, the temperatures used are those as specified for the particular commercially available one-part aerated fluidizable bed grade or electrostatic grade resin powder being used. The actual rate at which the particle-containing layer 28 becomes heated is affected by the mass of the substrate article and by the thickness of the coating 28. Thicker coatings or more massive substrate articles require an increased length of time for the applied heat to "soak" in. In general, the thermoplastic resin materials, as specified, may require a somewhat higher temperature to accomplish the desired flow out and bonding; whereas, the thermosetting plastics may require a somewhat longer time under heat to secure the desired cured strength.

Anti-slip surfaces 35 of this invention, as depicted in FIG. 2, preferably comprise the substrate 15, a primer layer 37 and a resin-particulate matter layer 38. It will be appreciated that, although the surface represented by the substrate is planar, cylindrical, rodlike, shaftlike, or irregularly-shaped surfaces having such a coating will also have anti-slip characteristics. However, the surfaces in their simplest form comprise a prepared substrate, as above, onto which a mixture of a dry powdered resin and a particulate material has been cascaded and adhered thereto by heating.

Preferably, as an example for an anti-slip surface, the resin is epoxy resin and the particulate matter is alumina. The particle size of the alumina is No. 60 to No. 80 grit size, and the mixture 9 comprises 8 to 10 parts by weight of alumina per part of powdered epoxy resin. The powdered epoxy resin may be any commercially available one-part powdered epoxy resin graded for either aerated fluidized bed applications or electrostatic powder spraying applications. The finished anti-slip coating is 30 to 50 mils thick and the cleaned and etched surface was primed with fine expoxy powder resin of 30 to 50 microns in size to a thickness of one to three mils.

Preferably, as an example for a reflective surface, the powdered resin is clear epoxy and the particulate material is glass particles of a No. 50 grit size. The mixture 9 comprises 12–14 parts by weight of the glass particles per part of the powdered epoxy resin, which is of the commercially available grades, as discussed in the preceding paragraph.

Because the process of this invention uses powdered resins, attractive effects, including color variations, can be obtained merely by changing the particulate matter supplied with the resin mixture. Thus, when the particulate matter is glass, the colors can be varied at will and cleanly.

I claim:

1. The method of making particulate matter-containing plastic coatings upon articles for producing a coating selected from the group consisting of anti-slip coatings, reflective coatings and electrical insulating coatings comprising the steps of:

preparing the surface of the articles by cleansing and etching, mixing dry powdered resin and dry particulate matter together with each other before application to the prepared surfaces of the articles, said dry powdered resin being a finely divided grade of resin powder selected from the group consisting of free-flowing fluidizable bed grade or electrostatic powder spraying grade, said particulate matter being selected from the group consisting of alumina grit, silicon carbide grit, silica sand grit, glass particles, quartz grit, and fiberglass particles less than one-eighth of an inch long, and mixtures thereof, said dry particulate matter having a particle size in the range from No. 50 to No. 100 grit size, the loading of the dry particulate matter in said mixture being in the range from 5 to 14 parts by weight of the particulate matter per part of the dry powdered resin, advancing said dry mixture of resin and particulate matter along a trough having a downwardly inclined wide, flat bottom surface terminating in a cascade lip, levelling the advancing dry mixture in said trough to a predetermined uniform thickness before the advancing mixture reaches said cascade lip, allowing said dry mixture of uniform thickness to cascade over said lip, moving the prepared articles beneath said cascade lip and allowing the cascading dry mixture to fall directly onto the prepared surface of each article, providing a vertical spacing between said cascade lip and the prepared surfaces of the articles to be coated which is in the range from approximately $\frac{1}{8}$th to $\frac{1}{2}$ of an inch, and adhering the dry mixture to the article by heating for forming a trough, durable coating having a thickness of from approximately 30 mils to 80 mils.

2. The method of claim 1, including the step of further preparing the surfaces of the cleansed and etched articles by applying a layer of finely divided powdered resin onto the cleansed and etched articles approximately one to three mils thick to provide a primary coating, said finely divided resin of said primary coating being of the same kind as in said dry mixture.

3. The method of claim 2, wherein said coating is an anti-slip coating, and in which said particulate matter is a grit having a grit size in the range from No. 60 to No. 100, and the coating has a thickness of from approximately 30 mils to approximately 50 mils.

4. The method of claim 3, wherein said anti-slip coating is on surfaces intended for use for walking or running, in which said dry powdered resin is epoxy resin, said grit size is in the range from No. 60 to No. 80, and the dry mixture comprises 8 to 10 parts by weight of the dry particulate matter per part of said dry powdered epoxy resin, thereby providing good anti-slip properties while anchoring the grip particles firmly in place to resist the rolling forces and overturning moments caused by lateral skidding thrusts of shoe soles along the surfaces.

5. The method of claim 4, in which said articles are constructional elements for use in assembling platforms, swimming pool decking, floor surfaces, sports area surfaces, stairs, corridors, walkways and ladders.

6. The method of claim 3, wherein said anti-slip coating is on surfaces intended for use primarily for sitting, in which said grit size is No. 100.

7. The method of claim 2, in which said priming layer is formed of finely divided powdered resin of 30 to 50 microns is size and is applied electrostatically to the articles being prepared.

8. The method of claim 2, in which said priming layer is formed of finely divided powdered resin of 30 to 50 microns in size and is applied by a roller having a nap to the articles being prepared.

9. The method of claim 4, wherein said anti-slip coating is reinforced by fiberglass particles, including the steps of selecting aluminia grit from said group and mixing said alumina grit with dry epoxy resin powder and fiberglass particles less than one-eighth of an inch long, said fiberglass particles being present in an amount of 2% to 10% by weight of the dry powdered resin.

10. The method of claim 2, wherein said coating is a reflective coating, and in which said particulate matter is glass particles of a No. 50 grit size, said dry powdered resin being clear epoxy, and said dry mixture comprising 12 to 14 parts by weight of the glass particles per part of the powdered epoxy resin.

11. The method of making plastic coatings upon articles which can be readily rotated such as cylinders, rods, and shafts comprising the steps of:

preparing the surfaces of the articles by cleansing and etching, preheating the article, applying primary coating layer of finely divided powdered thermoplastic resin to the pre-heated article, mixing dry powdered thermoplastic resin of the same type of resin as said priming layer with dry particulate matter, said particulate matter being selected from the group consisting of alumina grit, silicon carbide grit, silica sand grit, glass particles, quartz grit, and fiberglass particles less than one-eighth of an inch long, and mixtures thereof, said dry powdered resin being a finely divided grade of powdered resin selected from the group consisting of free-flowing fluidizable bed grade or electrostatic powder spraying grade, said dry particulate matter having a particle size in the range from No. 50 to No. 100 grit size, the loading of the particulate matter in said mixture being in the range from 5 to 14 parts by weight of the dry particulate matter per part of the dry powdered resin, advancing said dry mixture of resin and particulate matter along a trough having a downwardly inclined wide, flat bottom surface terminating in a straight cascade lip, levelling the advancing dry mixture in said trough to a predetermined uniform thickness before the advancing mixture reaches said cascade lip, allowing said dry mixture of uniform thickness to cascade over said lip, rotating the prepared preheated priming-coated articles below said cascade lip at a predetermined distance beneath said lip with the axis of rotation being parallel with said lip for allowing the cascading dry mixture to fall directly onto said priming-coated layer on the rotating, preheated article, providing a vertical spacing between said cascade lip and said priming-coating layer which is in the range from approximately $\frac{1}{8}$th to $\frac{1}{2}$ of an inch, further adhering the dry mixture to the article by heating for forming a tough, durable coating having a thickness of from approximately 30 mils to 80 mils.

12. The method of claim 11, wherein said priming-coating layer has a thickness in the range from approximately 1 to 3 mils, said particulate matter has a size in the range from No. 50 to No. 100 grit size, and said coating is from 30 to 80 mils thick.

* * * * *